US005887329A

United States Patent [19]

Pfeiffer

[11] Patent Number: 5,887,329

[45] **Date of Patent: *Mar. 30, 1999**

[54] PRESS TOOL

[75] Inventor: Heinrich Pfeiffer, Kaarst, Germany

[73] Assignee: Novopress GmbH Pressen und Presswerkzeuge & Co. KG, Germany

[ * ] Notice: The term of this patent shall not extend beyond the expiration date of Pat. No. 5,666,711.

[21] Appl. No.: 802,102

[22] Filed: Feb. 19, 1997

Related U.S. Application Data

[63] Continuation of Ser. No. 448,436, Jun. 2, 1995, Pat. No. 5,666,711.

[30] Foreign Application Priority Data

Dec. 2, 1992 [DE] Germany ..... 42 40 427.4

[51] Int. Cl.[6] ..... B25B 27/14

[52] U.S. Cl. ..... 29/272; 29/282; 29/283.5; 269/43

[58] Field of Search ..... 29/272, 464, 283.5, 29/282; 269/43, 130–132; 228/44.3, 44.5; 24/19, 270, 268

[56] References Cited

U.S. PATENT DOCUMENTS

| | | |
|---|---|---|
| 1,885,128 | 11/1932 | Montgomery . |
| 2,097,048 | 10/1937 | Statler . |
| 3,828,403 | 8/1974 | Perrin et al. . |
| 3,905,578 | 9/1975 | Watson, Sr. . |
| 3,920,232 | 11/1975 | Clark . |
| 3,979,814 | 9/1976 | Lajoie et al. . |
| 4,969,923 | 11/1990 | Reeder et al. . |
| 5,165,160 | 11/1992 | Poncelet . |
| 5,263,230 | 11/1993 | Johnson . |
| 5,380,052 | 1/1995 | Hendrickson . |

FOREIGN PATENT DOCUMENTS

| | | |
|---|---|---|
| 0451806 | 4/1991 | European Pat. Off. . |
| 1187870 | 10/1965 | Germany . |
| 2118782 | 9/1982 | Germany . |
| 3423283 | 6/1984 | Germany . |
| 4012504 | 4/1990 | Germany . |
| 9216369 | 12/1992 | Germany . |

*Primary Examiner*—Robert C. Watson
*Attorney, Agent, or Firm*—Joseph W. Berenato, III

[57] ABSTRACT

A press tool for joining workpieces has a wraparound ring consisting of hinged clamping components, in which the press tool is open at at least one closing point between the clamping components and has grips at that position for a closing device by means of which the clamping components can be brought together to form a closed ring. In order to facilitate handling the press tool especially with large pipe diameters, there is at least one coupling member (49, 50) by means of which the adjacent clamping components (6, 10) can be temporarily connected, the coupling member (49, 50) being designed so as to be flexible in the coupled position in the closing direction.

6 Claims, 5 Drawing Sheets

PRESS TOOL

Figure 1:
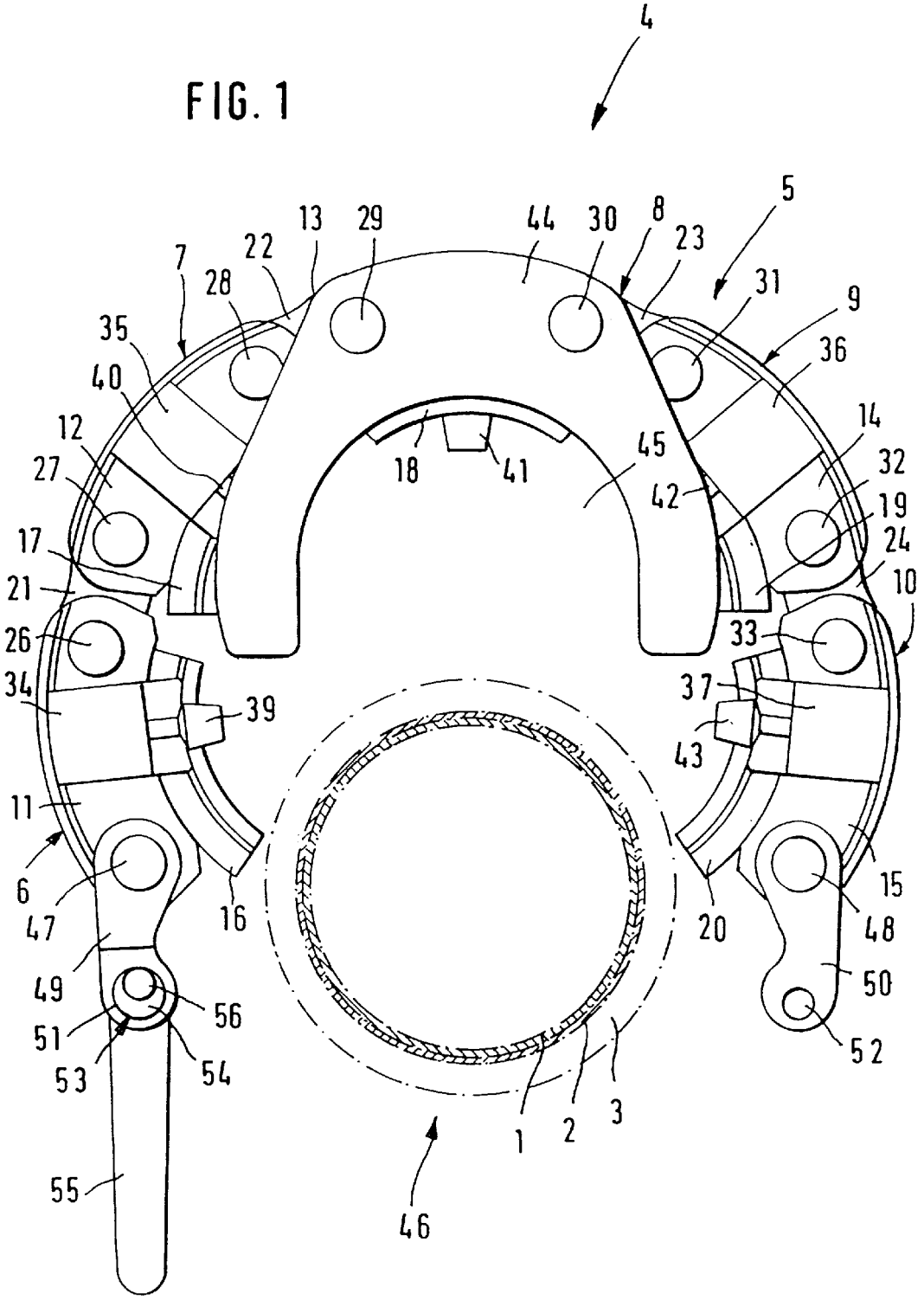
Figure 2:
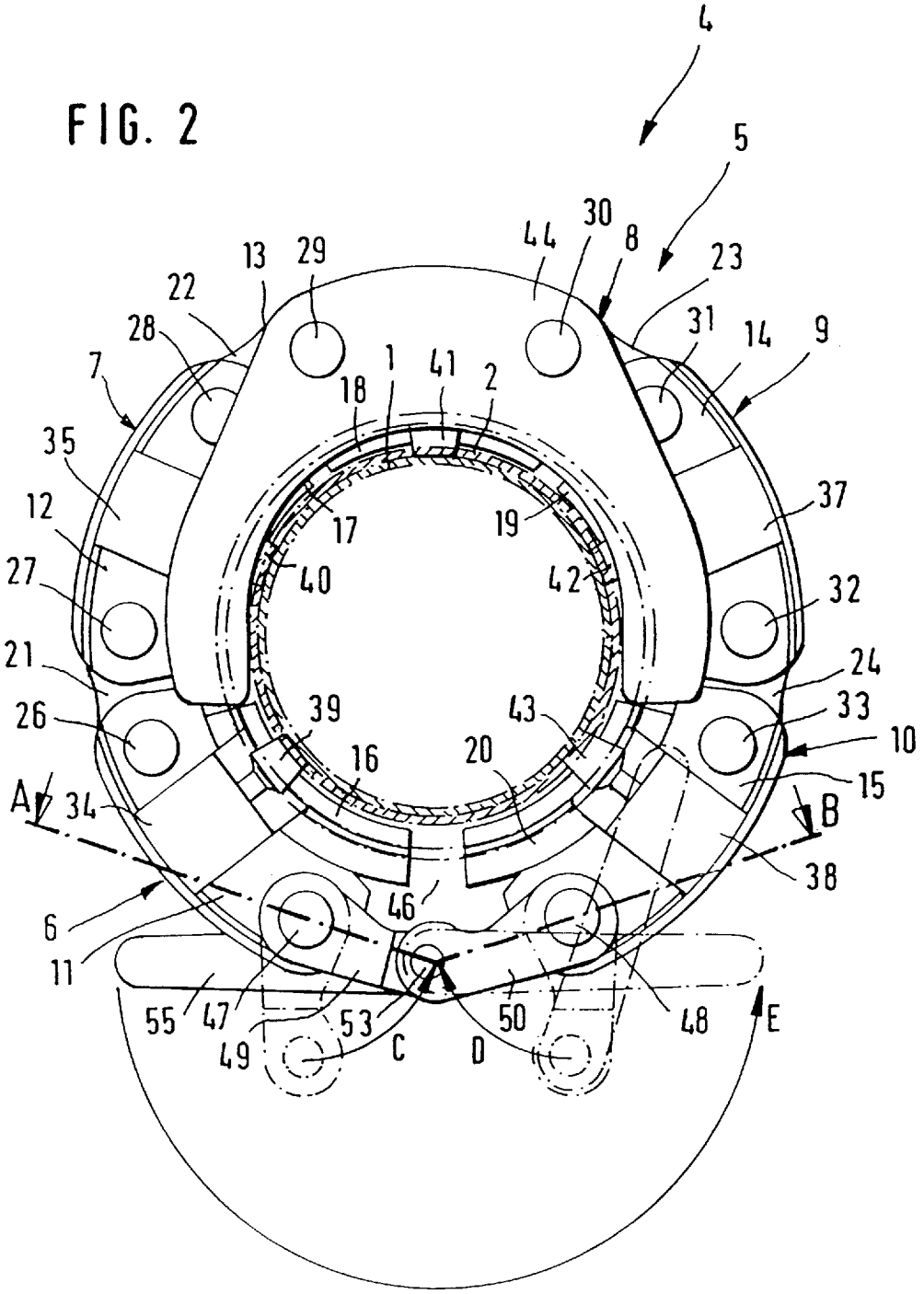
Figure 3:
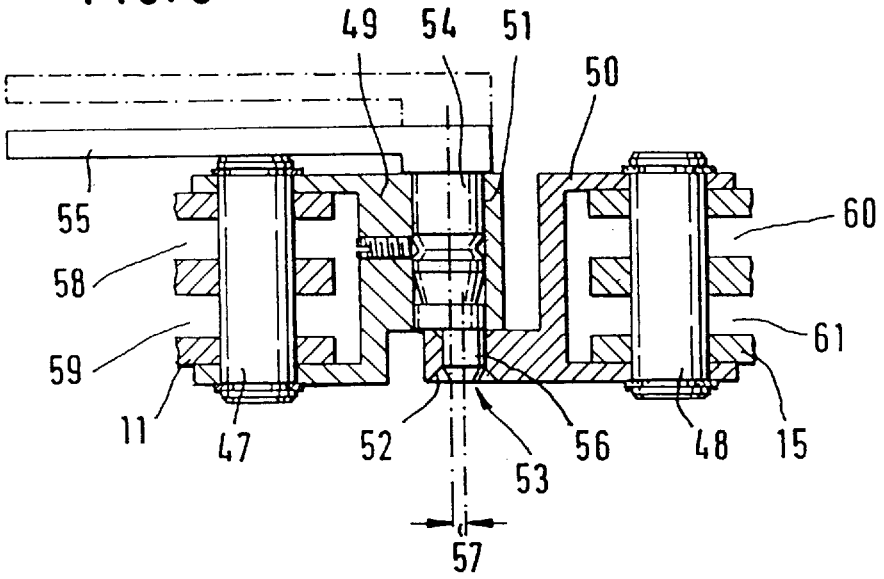
Figure 4:
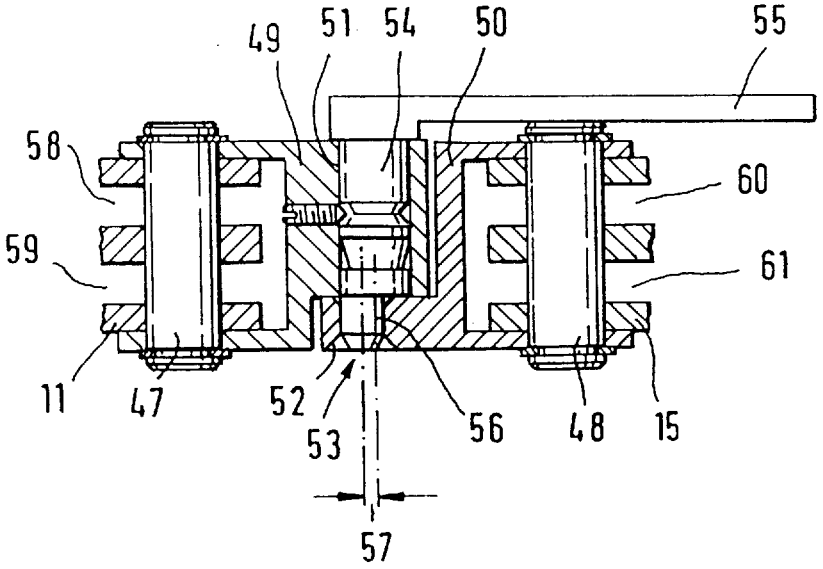
Figure 5:
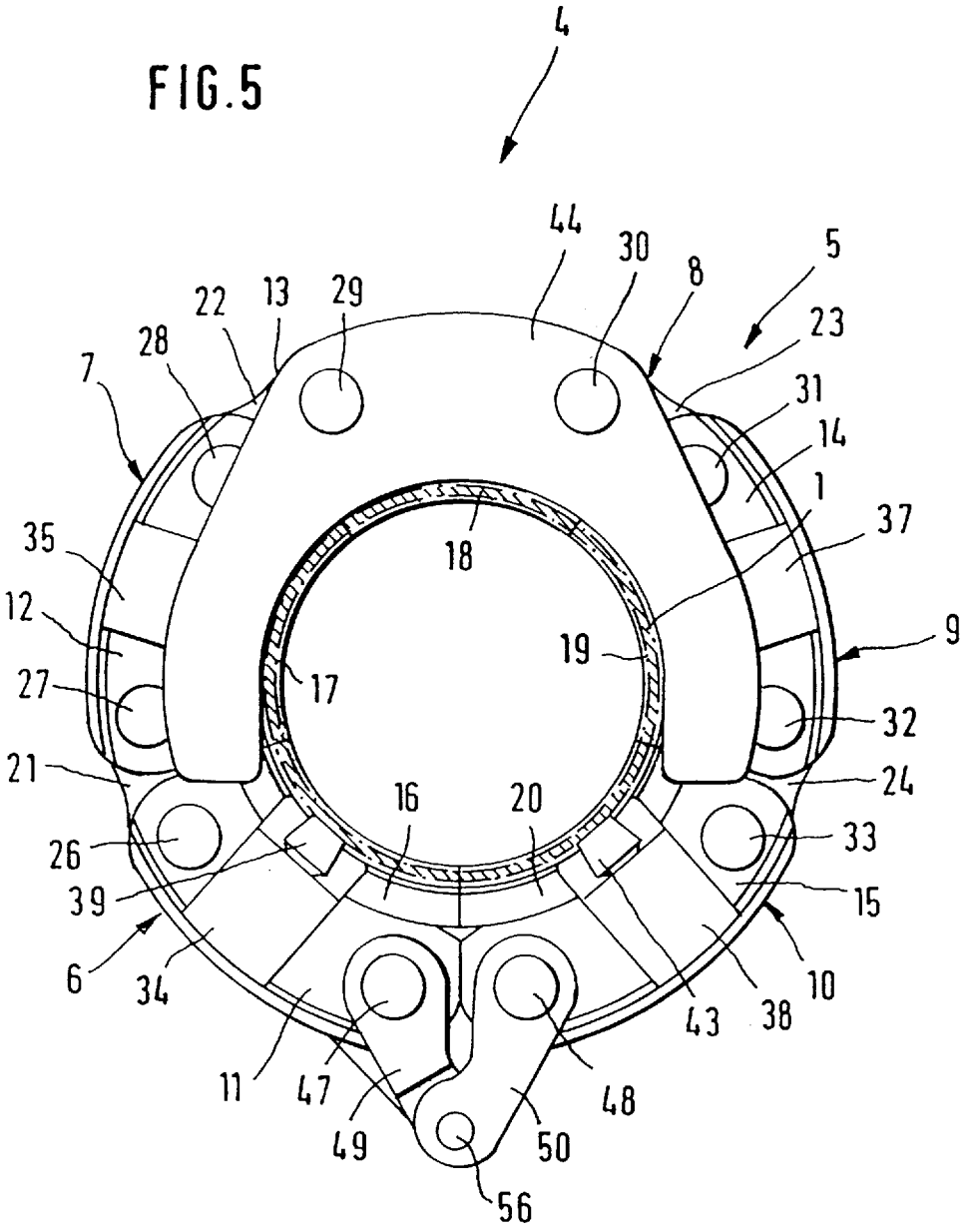
Figure 6:
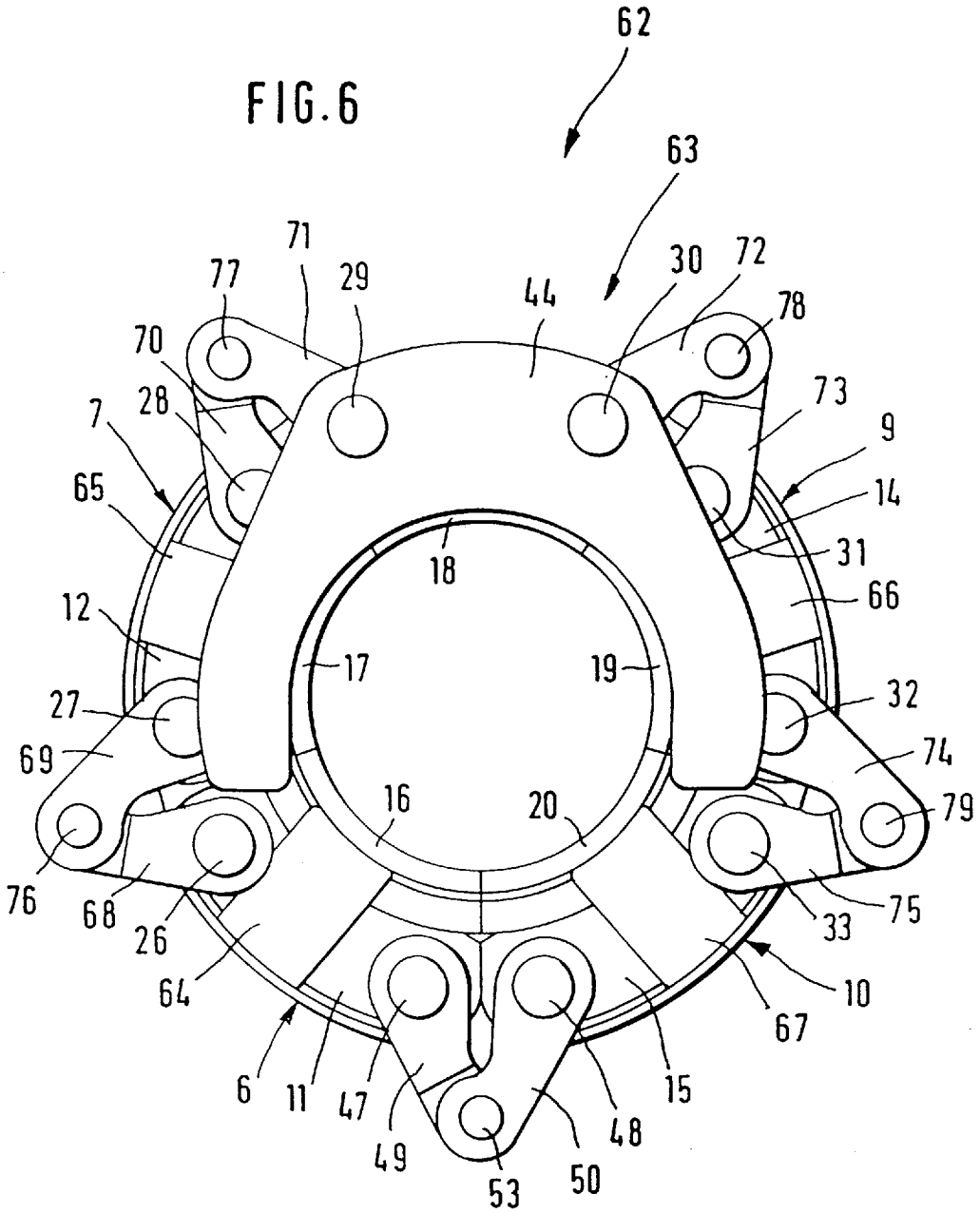

This application is a continuation of Ser. No. 08/048,936 filed Jun. 2, 1995 now Pat. No. 5,666,711.

The invention involves a press tool, specifically for joining tubular workpieces, having a wraparound ring comprised of at least three hinged clamping components, in which the press tool is open at at least one closing point between two clamping components and has grips at that position for a closing device by means of which the clamping components can be brought together to form a closed ring.

One known-in-the-art process for joining the ends of tubular workpieces involves using tubular press fittings that are ductile and are comprised of metal, preferably of steel. The inside diameter of the fittings is greater than the outside diameter of the pipe ends to be joined, so that when the fittings are pressed together radially in order to mount them on the surface of the pipe ends they will become permanently deformed. These types of pipe joints and the associated press fittings can be found, for example, in DE-C1 187 870 and DE-C-40 12 504.

For the process of pressing the fittings together radially, a wide range of press tools have been developed. Because in the past this process has been used primarily in the joining of smaller diameter pipe ends, press tools having only two clamping components have been developed (comp. DE-A-34 23 283). If greater diameter reductions or insertion depths are required, for example if the pipe joint will be required to withstand greater internal pressures, it becomes necessary for the press tool to contain more than two clamping components to prevent the formation of lands on the outside, between the surfaces of the clamping jaws, which would prevent them from closing completely. Simply designed press tools of this type can be found in EP-A-0 451 806. In relation to this, the press tools illustrated in FIGS. (7) and (8) are of particular interest, as they are suited to the joining of pipe ends that are large or very large in diameter.

These press tools contain a wraparound ring that is open at one closing point and is comprised of hinged clamping components, which are comprised of a clamping bracket and clamping jaws that can be moved circumferentially. This type of wraparound ring can be positioned like a collar around the point that is to be pressed, and then drawn together with the help of a closing device. The closing device may be permanently connected to the wraparound ring. If the wraparound ring is intended and designed for pressing larger pipe diameters, however, it is more advantageous in terms of weight and handling to design the closing device as a unit that is separate from the wraparound ring, which can be attached to the wraparound ring in the area of the closing point, after the ring has been positioned around the press fitting; specifically it can be attached to grips that are intended for this purpose and are fitted to the closing device on both of the clamping components that are adjacent to the closing point.

It would be desirable to expand the application of such press tools to include even greater pipe diameters. The wraparound ring then becomes so heavy, however, that handling and safety problems result in placing it around the pipe end or around the press fitting. It is thus the object of the invention to design a press tool of the type described in the beginning for which handling, particularly for larger pipe diameters, is facilitated.

This object is attained in accordance with the invention in that it includes at least one coupling member by means of which the clamping components adjacent to the closing point can be connected, with the coupling member being designed so as to be flexible in the coupled position in the closed direction.

Thus, in accordance with the basic premise of the invention, after the wraparound ring has been placed around the pipe end or the press fitting, it can be temporarily secured, causing the open closing point to be bridged over by a coupling member, which closes the wraparound ring. The wraparound ring is then unable to slide off, which eliminates the need to secure the wraparound ring for the attachment of the closing device so that the drawing together of the clamping components to form a closed wraparound ring in the coupled position will not be hindered, or will not be significantly hindered, the coupling member is designed in accordance with the invention to be flexible in the closing direction, but to limit the flexibility of the clamping components in the opening direction.

In a lighter dimensioned press tool, the entire coupling member can be dimensioned such that the wraparound ring remains able to rotate around the workpiece. In heavily dimensioned press tools for larger pipe diameters, however, it is preferable for the coupling member to be dimensioned such that a peripheral force is exerted on the wraparound ring that has been placed around the workpiece with the coupling member in the closed position, so that the wraparound ring is fitted with a certain degree of initial tension to the workpiece that is to be pressed, specifically the press fitting, leaving the wraparound ring at least unable to rotate on its own.

Several embodiments are possible for the design of the coupling member. For instance, the coupling member may contain a first coupling bracket that is hinged to the first clamping component, and a second coupling bracket that is connected to the other clamping component, whereby both coupling brackets may be hinged to one another, for example via a coupling pin that is set into both coupling brackets. This type of coupling member limits the flexibility of the clamping components in the opening direction, but is able, during the pressing process, to yield toward the outside with the help of the closing device, without offering significant resistance to the closing device.

To ensure a simple and convenient mounting, in other words the bridging over of the closing point via the coupling member, it is recommended in accordance with the invention for the coupling pin in the above-mentioned embodiment of the coupling member to contain a first pin segment that is set into the first coupling bracket and a second pin segment that can be set into the second coupling bracket, with the axes of the pin segments being displaced in relation to one another. The second pin segment thus creates an eccentric. This design makes it possible to insert the coupling pins even if no initial tension is being exerted on the press fitting, by rotating the coupling pins to exert a peripheral force. To enable this, the length of the coupling brackets and the extent of the displacement of the axes of the pin segments in the coupling pins in relation to the circumferential extension of the closing position must be appropriately coordinated. To facilitate the rotation of the coupling pin, it is connected to a lever. This is intended to permit the coupling pin to be captively directed into one of the coupling brackets.

A further feature of the invention provides for the coupling brackets to be hinged via hinge pins to the corresponding clamping components, and for recesses to be included in the area of the hinge pins, behind which closing elements of the closing device can catch. The hinge pins in this exemplary thus also form the grips for the closing device.

As an alternative to or in combination with the above embodiment, at least one clamping device for the purpose of mounting the wraparound ring on the inserted workpiece can be attached to one side of the ring, in which the clamping device(s), for example, may contain clamping elements that are under spring tension. Thus, following the temporary coupling of the wraparound ring via the coupling member, these clamping devices are positioned adjacent to the inserted workpiece, such that the upcast workpiece is unable to slide off. This facilitates the mounting process, particularly in the case of perpendicular or diagonally laid pipework, and at the same time serves in the axial safeguarding of the two nested workpieces.

The press tool specified in the invention is not limited to a design of the wraparound ring that contains only one open closing point. Particularly if the press tool is intended for the pressing of large diameter pipes and is correspondingly dimensioned to accommodate them, it can be advantageous for the wraparound ring to contain more than one closing point and for each closing point to contain a coupling member that is designed in accordance with the invention. This design makes it possible to assemble the wraparound ring from individual elements on the spot, in other words in the area of the pipe ends that are to be joined, or even in succession as the wraparound ring is being placed around the pipe end. It is also possible for the design to contain, between all the clamping components, a closing point that can be bridged over with a coupling member.

The constriction of the wraparound ring, and thereby the pressing of the pipe end with the press fitting, can occur in succession in such a way that the closing points are drawn together, with the help of the closing device, one after another. Another possibility, however, is for one of the closing devices, the number of which corresponds to the number of closing points, to be set in position, and for the closing points to then be pulled together synchronously.

This may also be achieved by connecting the clamping components to one another outside of the closing point(s) via removable hinge pins, as this will also allow the wraparound ring to be conveniently assembled on location. In addition, the clamping components may be connected via adapters to which the adjacent clamping components are hinged via hinge pins, with at least one of the hinge pins per adapter being removable.

In a design that is known-in-the-art, each of the clamping components is comprised of a clamping jaw and a clamping bracket in which each clamping jaw is positioned in the clamping bracket such that it can move circumferentially; in this design the coupling member(s) are positioned adjacent to the clamping brackets, and the clamping brackets are hinged to one another. The coupling member(s) may, however, also be positioned directly on the clamping jaws.

In the diagrams, the invention is illustrated in greater detail with reference to one exemplary embodiment. These diagrams show:

FIG. (1)—the wraparound ring of a press tool in an opened position;

FIG. (2)—the wraparound ring in accordance with FIG. (1) in a closed position;

FIG. (3)—a sectional view of the coupling member of the wraparound ring in accordance with FIGS. (1) and (2) as indicated by plane A-B, with the coupling member in a loose position;

FIG. (4)—the coupling member in the representation in accordance with FIG. (3), in a taut position;

FIG. (5)—the wraparound ring in accordance with FIGS. (1) through (4) in its position following the pressing process, and FIG. (6)—a wraparound ring with closing points and coupling members between each clamping component.

In FIGS. (1), (2), and (5), a cross-section of a pipe end (1) and a press fitting (2) that has been slid onto the pipe end, with an annular ring (3) that contains a conical nipple, are indicated by a dot-dashed line. The pipe end (1) and press fitting (2) are to be pressed using a press tool (4), of which only the wraparound ring (5) is illustrated in FIGS. (1), (2), and (5).

The wraparound ring (5) in this exemplary embodiment contains clamping components (6, 7, 8, 9, 10) that are essentially identical in design, with each clamping component (6, 7, 8, 9, 10) being comprised of an outer clamping bracket (11, 12, 13, 14, 15) and an inner, curved, clamping jaw (16, 17, 18, 19, 20). With one exception, the clamping brackets are connected to one another via adapters (21, 22, 23, 24), with the clamping brackets (11, 12, 13, 14, 15) being hinged via hinge pins (26, 27, 28, 29, 30, 31, 32, 33) to the adapters (21, 22, 23, 24).

In each case at least one hinge pin (26, 27, 28, 29, 30, 31, 32, 33) per adapter (21, 22, 23, 24) is designed to be removable, so that the wraparound ring (5) can be dismantled into individual clamping components (6, 7, 8, 9, 10) or can be assembled from these on the spot. The clamping jaws (16, 17, 18, 19, 20) are positioned in the clamping brackets (11, 12, 13, 14, 15) such that they can shift circumferentially.

A clamping device (34, 35, 36, 37, 38) is attached to each clamping bracket (11, 12, 13, 14, 15) and contains a clamping piston (39, 40, 41, 42, 43) that is directed radially toward the inside and is held under spring tension. The clamping devices (34, 35, 36, 37, 38) also serve in the axial guidance of the clamping jaws (16, 17, 18, 19, 20).

The hinge pins (29, 30) on the center clamping bracket (13) support a jaw-shaped template (44) in the form of a metal component containing a semi-circular recess (45), in which the radius of the recess (45) is such that the template (44) fits over the pipe end (1) but not over the cylindrical portion of the press fitting (2) that is adjacent to the annular ring (3). This ensures that the wraparound ring (5) can be placed around the combination of pipe end (1) and press fitting (2) in only one, preferred way.

The lower clamping components (6, 10) have between them, in the positions indicated in FIGS. (1) and (2), a closing gap (46). In FIG. (1) this gap is large enough that the wraparound ring (5) can be placed over the press fitting (2) and the pipe end (1). The free ends of the clamping components (6, 10) that are adjacent to the closing gap (46) contain hinge pins (47, 48), with a coupling bracket (49, 50) being suspended from each hinge pin (47, 48). The shape of the coupling brackets (49, 50) and their connection to the hinge pins (47, 48) are indicated specifically in the sectional illustration in accordance with FIGS. (3) and (4).

The free ends of the coupling brackets (49, 50) contain openings (51, 52). A coupling pin (53) is inserted axially into the boring (51) in the coupling bracket (49). This pin contains a first pin segment (54), which extends through the boring (51). One end of the first pin segment (54) is connected to a hand lever (55). At the other end of the first pin segment (54) is a second pin segment (56), the axis of which is displaced in relation to the first pin segment (54) by a degree of eccentricity (57). The second pin segment (56) fits into the boring (52) in the other coupling bracket (50).

The coupling brackets (49, 50), together with the coupling pins (53), form a coupling element for the temporary connection of the ends of the wraparound ring (5) prior to the actual pressing process. For this purpose, the opened wraparound ring (5) is first placed over the pipe end (1) and the press fitting (2), as is indicated in FIG. (1). When the wraparound ring (5) is on the pipe end (1) or press fitting (2), the two lower clamping components (6, 10) are swung toward one another and on the pipe end (1), so that they assume the position illustrated in FIG. (2). The coupling brackets (49, 50) that then remain suspended, a position which is indicated in FIG. (2) by a dot-dashed line, are then swung toward one another in the directions of arrows C and D. The coupling pin (53) is then in a position in which its second pin segment (56) does not protrude from the boring (51), which is indicated in FIG. (3) by the dot-dashed line indicating the position of the hand lever (55).

The horizontal sweep of the coupling brackets (49, 50) continues up to the position at which they overlap and the borings (51, 52) merge. The coupling pin (53), and thereby also the hand lever (55), are then in a position in which the second pin segment (56) is shifted toward the other coupling bracket (50), and can thus easily be set into its boring (52) via the axial shifting of the coupling pin (53), and can thereby join the two coupling brackets (49, 50). In this position, the wraparound ring (5) still maintains a certain degree of slack.

The hand lever (55) is then swung 180° from the position indicated in FIG. (2) by solid lines, into the position indicated by a dot-dashed line, in the direction of the arrow E. This causes the second pin segment (56) to execute an eccentric motion and to shorten the distance between the two hinge pins (47, 48) by double the eccentricity (57). This is made clear in the comparison of FIGS. (3) and (4), with FIG. (4) illustrating the swung position. This movement exerts a peripheral force on the wraparound ring (5), which causes the clamping jaws (16, 17, 18, 19, 20) to press with a certain degree of radial tension on the press fitting (2). The wraparound ring (5) then has a fit that cannot be rotated or is at least very difficult to rotate. This effect is enhanced by the clamping pistons (39, 40, 41, 42, 43), which then press against the pipe end (1) with equal, radially directed tension, thus ensuring an axial mounting between pipe end (1) and press fitting (2).

Now the actual pressing process can begin. In this process, a closing device, which will not be described in greater detail and is part of the press tool, is used, as is known schematically from FIG. (7) of EP-A-0 451 806. This closing device contains two tong-shaped lever arms, by means of which the closing device can be attached to the hinge pins (47, 48). This causes them to extend through spaces (58, 59) or (60, 61) and to be adjacent to the outsides of the hinge pins (47, 48). The tong-shaped lever arms are then brought together by means of a hydraulic motor that is part of the closing device, so that the hinge pins (47, 48) approach one another. The result of this is that the wraparound ring (5) becomes constricted, which causes the press fitting (2) and the pipe end (1) to be radially compressed, whereby clamping jaws (16, 17, 18, 19, 20) are automatically displaced circumferentially, to the point at which the surfaces of the clamping jaws (16, 17, 18, 19, 20) are touching. At the same time, the coupling brackets (49, 50) yield toward the outside, which keeps them from interfering with the pressing process.

Following the conclusion of the pressing process, the wraparound ring (5) assumes the position illustrated in FIG. (5). After the axial displacement of the coupling pin (53), which causes the second pin segment (56) to slip out of the boring (52), the wraparound ring (5) can be removed and used for other pressing processes.

In FIG. (6), a somewhat modified press tool (62) from the above-specified embodiment is illustrated. This design is basically the same as for the press tool (4) illustrated in FIGS. (1) through (5), so that in FIG. (6), components that are identical to those in the press tool in accordance with FIGS. (1) through (5) are indicated by the same numbers. In the description of this modified press tool, reference is made to the description of the first exemplary embodiment.

In contrast with the press tool (4), the wraparound ring (63) of the press tool (62) illustrated in FIG. (6) has no clamping devices, and is instead equipped only with guide plates (64, 65, 66, 67), located in the same positions. Additionally, the clamping brackets (11, 12, 13, 14, 15) in this embodiment are connected not via adapters, but via pairs of coupling brackets (68, 69) or (70, 71) or (72, 73) or (74, 75), which are hinged to the hinge pins (26, 27, 28, 29, 30, 31, 32, 33) and are connected to one another via coupling pins (76, 77, 78, 79). The design of the coupling brackets (68, 69, 70, 71, 72, 73, 74, 75) and the coupling pins (76, 77, 78, 79) is identical to the design of the coupling brackets (49, 50) and the coupling pin (53).

In FIG. (6), the wraparound ring (63) is shown in a position that is occupied by the wraparound ring (63) following the pressing process, in which the surfaces of the clamping jaws (16, 17, 18, 19, 20) are touching. The wraparound ring (63) can be dismantled into the five clamping components (7, 8, 9, 10) by decoupling the pairs of coupling brackets (68, 69) or (70, 71) or (72, 73) or (74, 75). From this disassembled state it can in turn be assembled on the spot, even in the process of being mounted around a pipe end or press fitting, by coupling the pairs of coupling brackets (68, 69) or (70, 71) or (72, 73) or (74, 75), in a process that is similar to that associated with the pair of coupling brackets (49, 50) for the press tool (4) in accordance with FIGS. (1) through (5). The result is a closed wraparound ring (63), in which the pairs of coupling brackets (68, 69) or (70, 71) or (72, 73) or (74, 75) assume an elongated positioning, as is illustrated by the coupling bracket (49, 50) in FIG. (2).

The subsequently performed pressing process can occur via two different methods. In one method, five closing devices may be simultaneously attached to the pairs of hinge pins (26, 27) or (28, 29) or (30, 31) or (32, 33) or (49, 50), so that the distances between the clamping jaws (16, 17, 18, 19, 20) in the synchronous manipulation of the closing devices are simultaneously shortened to the opposite unit. The second method involves effecting the pressing process using only one closing device, in which the closing device is attached to the pairs of hinge pins (26, 27) or (28, 29) or (30, 31) or (32, 33) or (47, 48) one at a time, after which these are drawn together until the positioning of all clamping components (6, 7, 8, 9, 10) illustrated in FIG. (6) has been achieved.

I claim:

1. A press tool comprising:

means for coaxially aligning and joining corresponding ends of workpieces, including a wraparound ring having hinged clamping components, in which the press tool is open at at least one closing point between two clamping components and has at least one member at that position for a closing device;

means for bringing the clamping components together and forming a closed ring around the periphery of at least one of the workpieces to be coaxially aligned and joined; and at least one coupling member (49, 50) by means of which the clamping components (6, 10) adjacent to the closing point(s) (46) can be temporarily connected, with the coupling member (49, 50) being flexible in the coupled position in the closing direction during the coaxial aligning of the ends of the workpieces.

2. The press tool of claim 1, wherein the coupling member (49, 50) is dimensioned such that a peripheral force is exerted on the wraparound ring (5) when it has been placed around the workpiece (1, 2) and the coupling member has been closed.

3. The press tool of claim 1, wherein the wraparound ring has more than one closing point, and that one coupling member (49, 50; 68, 69; 70, 71; 72, 73; 74, 75) is included for each closing position.

4. The press tool of claim 1, wherein there is a closing position that can be bridged over via a coupling member between all clamping components (6, 7, 8, 9, 10).

5. A press tool comprising:

means for coaxially aligning and joining corresponding ends of workpieces, including a wraparound ring having hinged clamping components, in which the press tool is open at at least one closing point between two clamping components and has at least one member at that position for a closing device;

means for bringing the clamping components together and forming a closed ring around the periphery of at least one of the workpieces to be coaxially aligned and joined;

at least one coupling member (49, 50) by means of which the clamping components (6, 10) adjacent to the closing point(s) (46) can be temporarily connected, with the coupling member being flexible in the coupled position in the closing direction during the coaxial aligning of the ends of the workpieces;

pin segments (54, 56); and wherein the coupling member includes a first coupling bracket (49) that is hinged to the clamping component, and a second coupling bracket (50), and wherein the length of the coupling brackets (49, 50) and the displacement of the axes of pin segments (54, 56) in relation to the circumferential extension of the closing point (46) are coordinated such that a peripheral force is exerted upon the wraparound ring (5) when it has been placed around the workpiece and the coupling member has been closed.

6. A press tool comprising:

means for coaxially aligning and joining corresponding ends of workpieces, said means including a wraparound ring having hinged clamping components, in which the press tool is opened at at least one closing point between two clamping components and has at least one member at that position for defining a closing device;

means for bringing the clamping components together and forming a closed ring closely around the entire periphery of at least one of the workpieces to be coaxially aligned and joined, said means for bringing the clamping components together functioning so that said closed ring is approximately evenly spaced from the entire periphery of said at least one of the workpieces to be coaxially aligned and joined; and wherein said means for coaxially aligning and joining corresponding ends of workpieces further includes at least one coupling member for temporarily connecting clamping components (6, 10) adjacent to the closing point(s), said at least one coupling member being flexible in the coupled position in the closing direction during coaxial aligning of the ends of the workpieces.

* * * * *